US006976312B2

(12) United States Patent
Wiler

(10) Patent No.: US 6,976,312 B2
(45) Date of Patent: Dec. 20, 2005

(54) SPLIT-END HAIR CLIPPER

(76) Inventor: Pennie A. Wiler, 863 Oxford La., Colorado Springs, CO (US) 80906

( * ) Notice: Subject to any disclaimer, the term of this patent is extended or adjusted under 35 U.S.C. 154(b) by 0 days.

(21) Appl. No.: 10/844,118

(22) Filed: May 13, 2004

(65) Prior Publication Data

US 2005/0252008 A1 Nov. 17, 2005

(51) Int. Cl.[7] ..... B26B 15/00
(52) U.S. Cl. ..... 30/264; 30/34.2; 30/43.5; 30/43.6; 30/263; 30/265
(58) Field of Search ..... 30/34.2, 43.4, 30/43.5, 43.6, 263–265

(56) References Cited

U.S. PATENT DOCUMENTS 3,298,101 A * 1/1967 MacCarthy ..... 30/43.5
4,001,932 A * 1/1977 Herrick ..... 30/43.5
4,038,747 A * 8/1977 Upton ..... 30/34.2
4,413,410 A * 11/1983 Otsuka et al. ..... 30/43.6
4,475,285 A * 10/1984 Hara et al. ..... 30/41.6
4,635,360 A * 1/1987 Tanahashi et al. ..... 30/34.2
4,733,466 A * 3/1988 Fletcher, Jr. ..... 30/34.2
4,839,964 A * 6/1989 Uchiyama et al. ..... 30/43.6
4,910,869 A * 3/1990 Labrijn ..... 30/43.6
6,212,776 B1 * 4/2001 Izumi et al. ..... 30/43.4
6,553,668 B1 * 4/2003 Steinberg ..... 30/43.5

* cited by examiner

*Primary Examiner*—Allan N. Shoap
*Assistant Examiner*—Carolyn Blake
(74) *Attorney, Agent, or Firm*—Richard W. Hanes; Hanes & Schutz, LLC

(57) ABSTRACT

A split-end hair remover comprising an enclosure having top, bottom and sides, where the top includes a substantially planar screen having upper and lower surfaces that include a plurality of apertures through which one or more split hair ends may project, a motor carried within the enclosure that drives several sets of blades, each set of which is disposed around a center of rotation and where each of the blades of a set has a cutting edge disposed parallel to and proximate the lower surface of the planar screen.

4 Claims, 4 Drawing Sheets

SPLIT-END HAIR CLIPPER

FIELD OF THE INVENTION

The present invention relates to hair cutting devices and more particularly to such a device that trims the split ends from a coif of hair.

BACKGROUND OF THE INVENTION

Split hair ends (trichoptlosis) come about when the protective cuticle of the hair has been stripped away from the ends of hair fibers. Split ends are more likely to develop in dry or brittle hair, and typical causes of damage include excessive dying or vigorous brushing. Once the hair cuticle is removed, it is impossible to replace. Typically the hair splits into two or three strands. The split can be a fraction of an inch to more than an inch in length.

The split ends create a frizzy and unkempt appearance to the hair. The best treatment is to cut off the split end of the damaged fiber. This is an easy solution when the split ends occur at the end of hair growth, but less effective or simple to accomplish when the frayed ends materialize on hair ends that do not terminate with the longest hair growth, that is, they occur at points intermediate the scalp and the end of the longest hair growth.

When the hair is not trimmed at its end length or when the split ends occur within the coif, a common treatment is to apply a leave-in conditioner with a light hold, or a pomade just on the tips that will hold the hair ends down within the adjoining hair strands. Except for trimming the end growth of a head of hair, clipping the intermediate split ends becomes a problem. For example, one process for such trimming requires the twisting of small sections of hair in a downward motion to expose the split ends. Then the twisted hair is snipped with sharp scissors into the thickness of the hair to remove the damaged cuticles and give a layered effect.

All of these solutions are cumbersome, time consuming and result in limited success. It is therefore the primary object of the present invention to provide a hand held electrically operated clipper that can be gently passed over a coif of hair to remove the split hair ends that protrude from the surface of the coif.

SUMMARY OF THE INVENTION

The hand held clipper of the present invention includes an enclosure having top, bottom and sides, where the top includes a substantially planar screen having upper and lower surfaces that include a plurality of apertures through which the split hair ends that come into contact with the screen may project. Immediately beneath and close to the undersurface of the apertured screen are several sets of rotating blades, each blade of each set being radially disposed around a center of rotation and having its cutting edge disposed parallel to and proximate the lower surface of the screen. Each set of blades is driven by a common motor.

DETAILED DESCRIPTION OF PREFERRED EMBODIMENT

Figure 1:
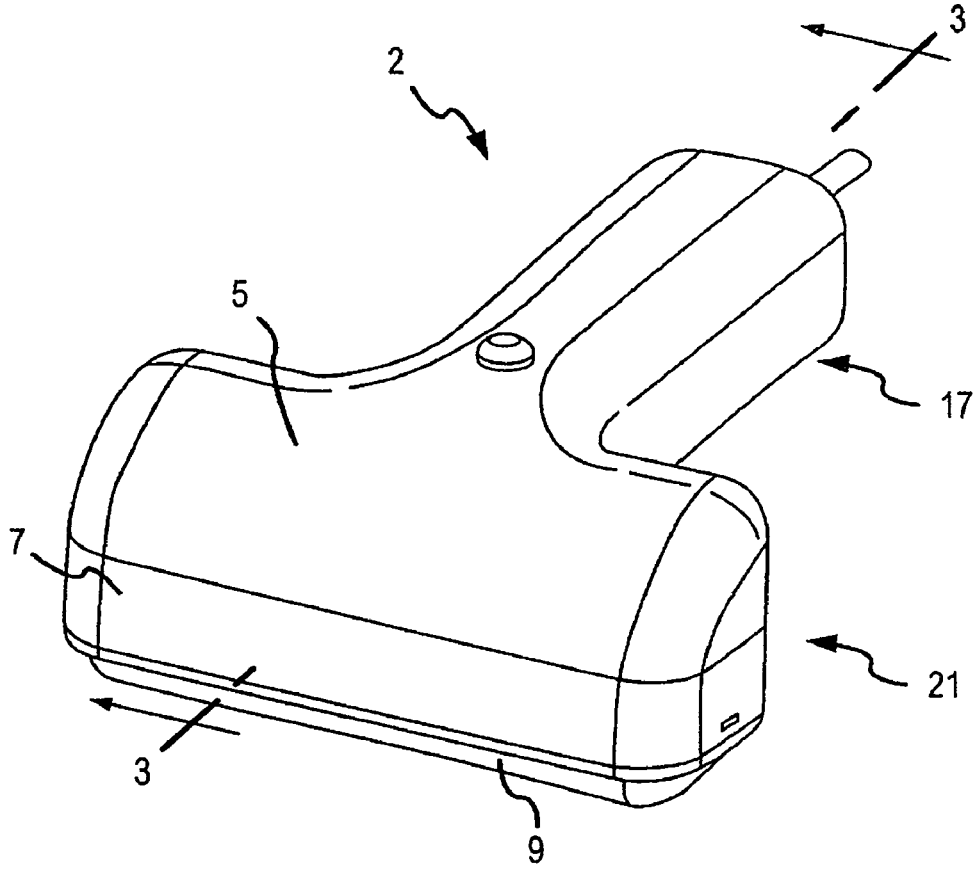
FIG. 1 is a perspective view of the hand held clipper of the present invention showing the handle portion and the perpendicularly disposed head that contains the cutting elements.
Figure 2:
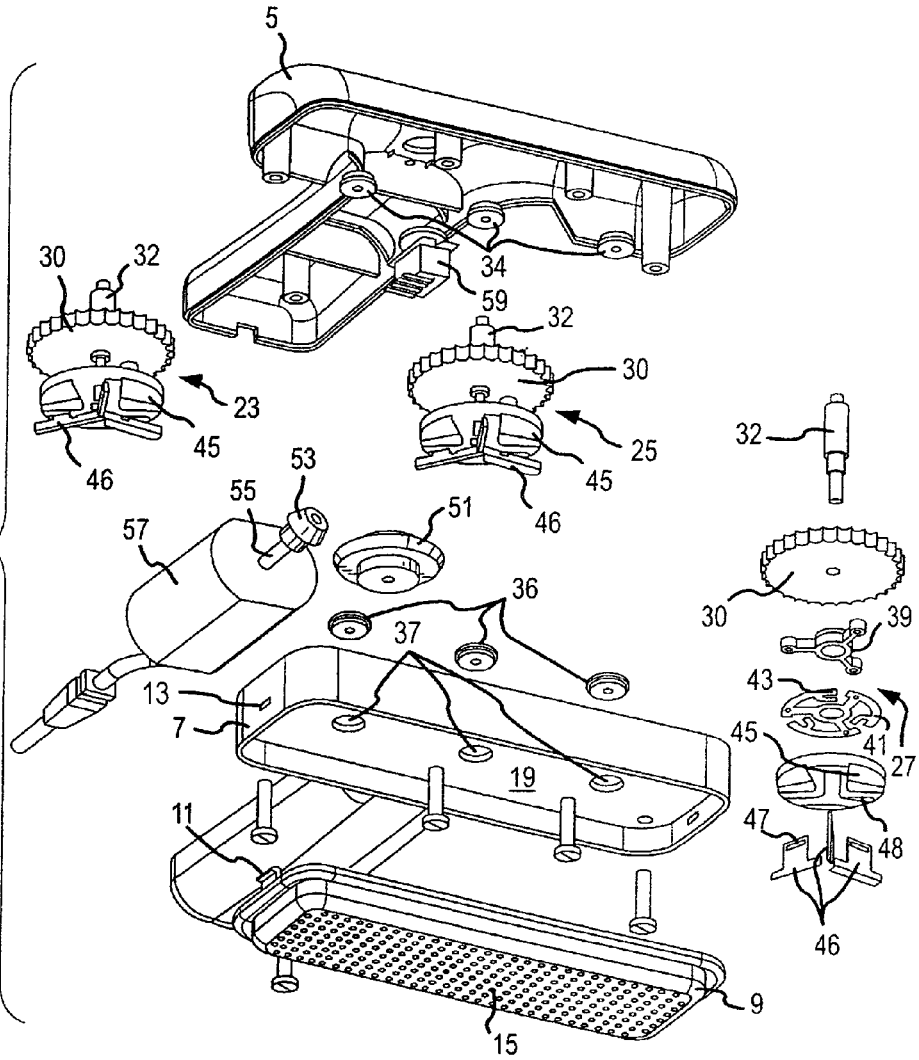
FIG. 2 is an exploded perspective view of the combination of parts comprising the clipper of the present invention.

Reference is first made to FIG. 1 that illustrates the exterior view of the housing of the split-end hair clipper 2. The housing structure comprises a top handle/head portion 5, a combined handle bottom and mid level head portion 7 and a screen mounting frame 9. The screen mounting frame attaches to the mid level head portion with a snap-in and release spring clip 11 disposed on one end of the screen mounting frame that snaps into a receiving slot 13 in one end of the mid level head portion 7. The screen mounting frame supports a meshed screen 15 the apertures of which receive the split end hairs to be clipped. The mesh of the screen is a factor in the successful operation of the device as a split-end clipper. The mesh should be large enough to admit entry of the small split portions of a hair strand and fine enough to bar the entry of a normal hair strand.

Figure 3:
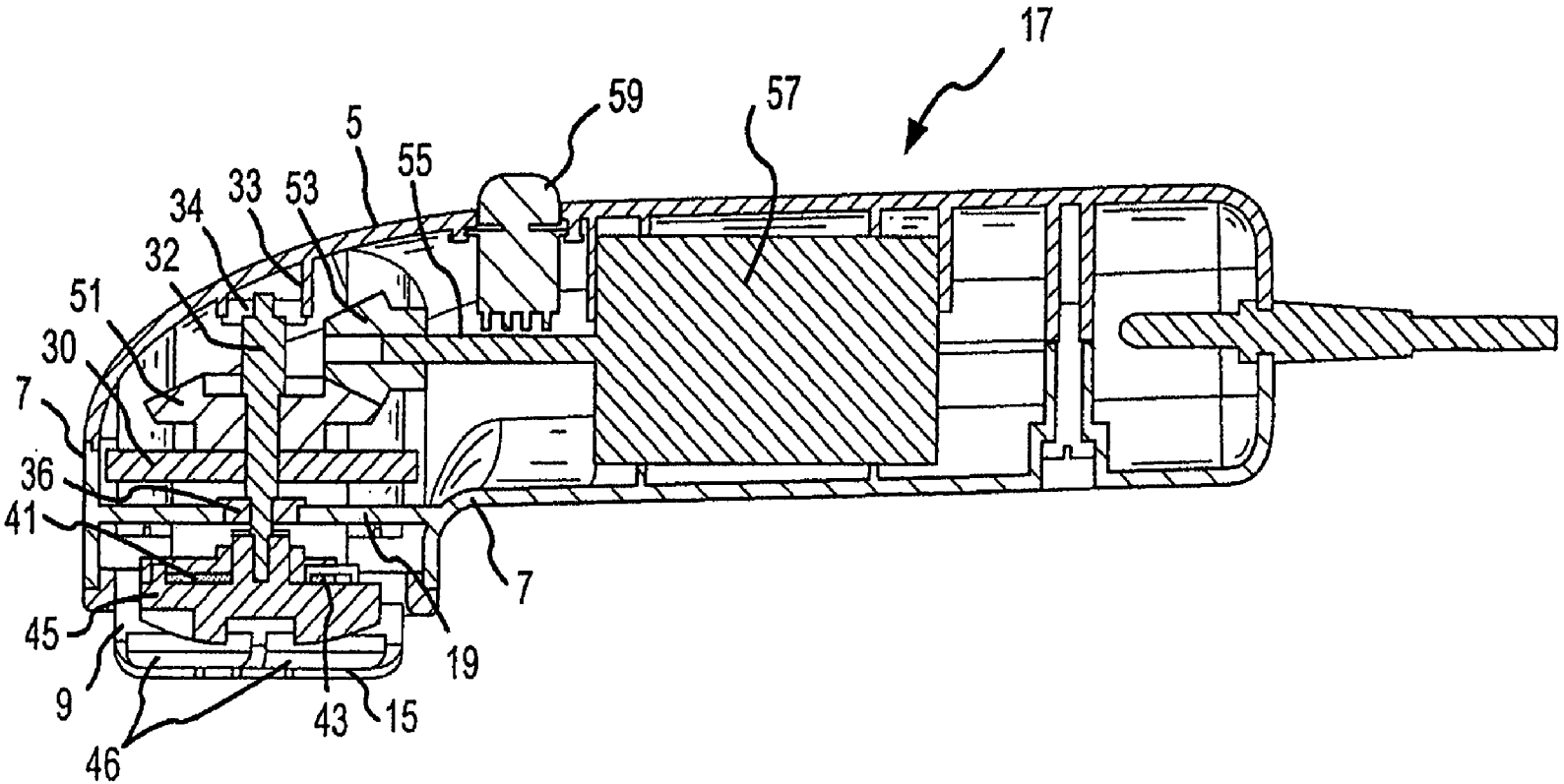
FIG. 3 is a longitudinal cross sectional view of the clipper.
Figure 4:
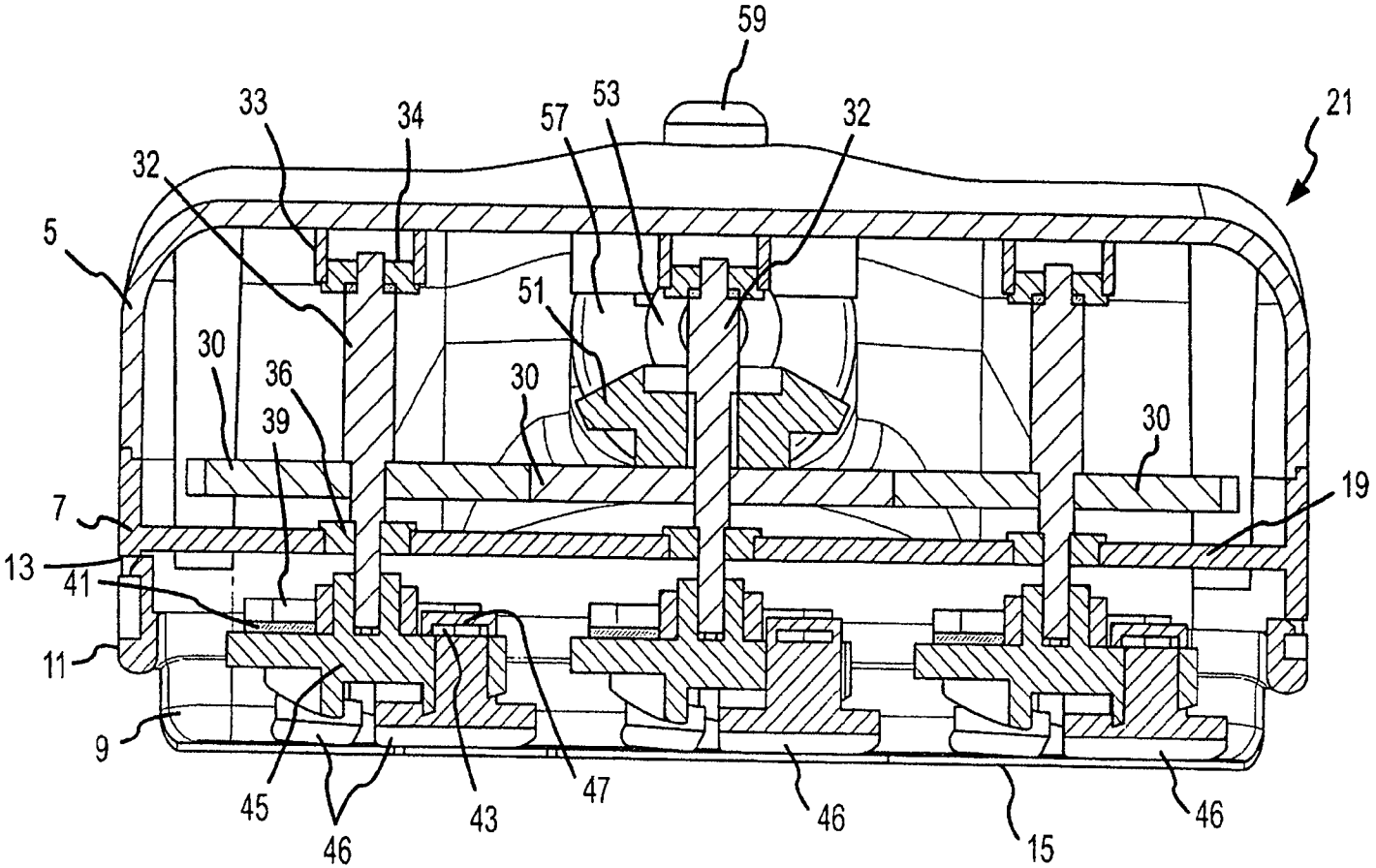
FIG. 4 is a lateral cross sectional view of the head of the clipper.

The mid level head portion combines the bottom half of the handle 17 with a peripheral head frame having a mid-level floor 19. Operatively supported within the head 21 of the clipper 2 are three blade mounting assemblies 23, 25, and 27, all of which are identical and will be described by reference to the component parts of an example one of the assemblies 27, shown in the exploded view in FIG. 3. A spur gear 30 is mounted on a rotatable gear shaft 32 that is supported at its top end with a bushing 33, integrally formed with the top cover portion 5, and a bearing 34. The mid section of the gear shaft 32 is supported by a bearing 36 disposed in an aperture 37 in the floor 19 of the mid level head portion of the housing.

Adjacent the lower surface of the spur gear 30 is a three-armed base member 39 whose function is to support a cutting blade biasing spring 41. The spring comprises a central annulus that surrounds the gear shaft with three equally spaced radially extending arms, each supporting a springable arc that terminates in a dual prong fork 43. Below the spring 41 and carried by the gear shaft 32 is a cutter blade mounting head 45 that supports three radially extending cutter blades 46. The base of each of the blades is slidingly received in a supporting through-slot 48 in the mounting head. To provide an operating connection with the blades, the three forked ends 43 of the spring 41 are inserted into respective ones of openings 47 in the base of each cutting blade 46. The springs 41 bias the slidable cutting blades against the inside surface of the meshed screen 15.

The intermeshed spur gears 30 of each of the blade mounting assemblies 23, 25 and 27 provide the motive power for rotation of the cutting blades 46 on each of the assemblies. On the upper side of the spur gear 30 and carried by the gear shaft 32 of the central assembly 25 is located a circular pinion 51 having circumferential sides that slope for engagement with a mating gear 53. The gear 53 is mounted on the end of the shaft 55 of an electric motor 57 carried within the handle 17. An operating switch 59 is located at the top of the handle, however the traditional wiring of the switch, motor and power cord are not illustrated in the drawings.

In operation, when the motor is turned on by the operation of the switch 59 the rotation of the motor shaft gear 53, by its engagement with the pinion 51, causes the central spur gear 30 and the associated spur gear shaft 32 to rotate. Due to the mutual intermeshing of the three spur gears 30, rotation of the central spur gear causes the spur gears and the spur gear shafts in the outside assemblies 23 and 27 to rotate at the same speed. As the mounting assemblies are energized by the turning motor shaft 55, the rotating cutting blades 46 are pressed against the inside surface of the meshed screen 15 and cut the split hair ends that protrude through the apertures in the screen. Inasmuch as the split ends of hair are of smaller diameter than healthy hair ends the latter will not enter through the screen 15 into the cutting chamber. By pulling a coif of hair taut and pressing the screen lightly against and coif and pulling it downwardly from the crown of the head the split hair ends that protrude from the coif will be cut as they enter through the screen 15 and one or two passes of the screen over a coif of hair will clean away the unwanted split hair ends that distract from one's appearance.

What is claimed is:

1. A split-end hair remover comprising:

an enclosure having a top, a bottom and sides, where the top includes a substantially planar screen having upper and lower surfaces that include a plurality of apertures through which one or more hair ends may project, motor means carried within the enclosure, at least one set of a plurality of blades, each blade of the at least one set being radially disposed around a center of rotation and having a cutting edge disposed parallel to and proximate the lower surface of the planar screen, spring means disposed in biasing contact with the plurality of blades for urging the cutting edge of each blade toward the lower surface of the planar screen, means mounting the at least one set of blades for rotation where the mounting means comprises a spur gear shaft and a blade carrying head mounted on the spur gear shaft and having means for receiving each of the plurality of blades, and means operably interconnecting the mounting means with the motor means, where the means operably interconnecting the mounting means with the motor means comprises a spur gear mounted for rotation with the spur gear shaft and pinion and gear means interconnecting the motor means with the spur gear.

2. A split-end hair remover comprising:

an enclosure having a top, a bottom and sides, where the top includes a screen having upper and lower surfaces that include a plurality of apertures through which one or more hair ends may project, motor means carried within the enclosure, a first plurality of gear shafts, a first plurality of intermeshed spur gears, each mounted for rotation on a respective one of the gear shafts, gear means operably interconnecting one of said first plurality of spur gears to the motor means, a first plurality of sets of a first plurality of blades, each blade of each set being radially disposed around a center of rotation and having a cutting edge disposed parallel to and proximate the lower surface of the screen, where the centers of rotation are the respective first plurality of gear shafts, and a first plurality of blade head means each mounted for rotation with a respective one of said spur gears and having means for slidably securing the first plurality of blades.

3. The remover of claim 2 and further including, a first plurality of spring means carried for rotation with each respective one of said first plurality of spur gears and disposed in contact with each one of the said first plurality of blades for biasing the cutting edge of each one of the said first plurality of blades toward the lower surface of the screen.

4. The remover of claim 3 where the spring means comprises, a first plurality of leaf bases, each having a first plurality of legs radially disposed from a respective gear shaft, and a first plurality of springs each having a first plurality of independent leaves, each of said leaves having first and second ends, said first end being in biasing contact with one of said first plurality of blades, said second end being secured to one leg of the respective bases.

* * * * *